United States Patent [19]

Veronesi et al.

[11] Patent Number: 4,886,430

[45] Date of Patent: Dec. 12, 1989

[54] CANNED PUMP HAVING A HIGH INERTIA FLYWHEEL

[75] Inventors: Luciano Veronesi, O'Hara Twp., Allegheny County; ALbert A. Raimondi, Monroeville Borough, Allegheny County, both of Pa.

[73] Assignee: Westinghouse Electric Corp., Pittsburgh, Pa.

[21] Appl. No.: 220,720

[22] Filed: Jul. 18, 1988

[51] Int. Cl.[4] ..... F04B 39/00

[52] U.S. Cl. ..... 417/423.13; 417/423.14; 74/572; 74/573 F; 310/74

[58] Field of Search ..... 415/112; 417/423.1, 417/423.7, 423.8, 423.12, 423.13, 423.14, 424.2; 74/572, 673 F; 310/74

[56] References Cited

U.S. PATENT DOCUMENTS

| | | | |
|---|---|---|---|
| 3,450,056 | 6/1969 | Heathcote et al. . | |
| 3,475,631 | 10/1969 | Stark et al. . | |
| 3,519,861 | 7/1970 | Guthan . | |
| 3,716,732 | 2/1973 | Tillma | 310/74 X |
| 3,918,830 | 11/1975 | Schneider . | |
| 3,947,153 | 3/1976 | Matthias et al. . | |
| 4,084,924 | 4/1978 | Ivanoff et al. . | |
| 4,203,710 | 5/1980 | Farr | 310/74 X |
| 4,296,976 | 10/1981 | Heshmat . | |
| 4,320,431 | 3/1982 | Bell . | |
| 4,464,592 | 8/1984 | Major | 310/54 |
| 4,465,437 | 8/1984 | Jensen et al. . | |
| 4,523,896 | 6/1985 | Lhenry et al. | 417/423.12 |
| 4,545,741 | 10/1985 | Tomioka et al. | 417/423.13 |
| 4,557,265 | 12/1985 | Andersson | 128/339 X |
| 4,616,980 | 10/1986 | Carpenter . | |
| 4,684,329 | 8/1987 | Hashimoto . | |
| 4,728,314 | 3/1988 | Eckel et al. | 74/573 F X |

FOREIGN PATENT DOCUMENTS

| | | |
|---|---|---|
| 59-29849 | 2/1984 | Japan . |
| 59-29852 | 2/1984 | Japan . |
| 721091 | 3/1980 | U.S.S.R. . |

OTHER PUBLICATIONS

"Best LWR for Worldwide Needs," Toshiba, date unknown.

"Industrial Uses for Depleted Uranium," Lowenstein, ASM, 1980.

"Reactor Coolant System Design of the Advanced (W) 600 MWE PWR," Vijuk and Tower, Aug. 10–14, 1987.

"Passive and Simplified System Features for the Advanced Westinghouse 600 MWe PWR," Tower, Schulz, and Vijuk, Aug. 24, 1987.

"Conceptual Design for an Advanced Passive 600 MWe PWR," Bruce and Vijuk, Oct. 1987.

"AP600–AN ALWR Conceptual Design," Bruce and Vijuk, Aug. 1988.

"Westinghouse PWR Designs Get Better Through Technology Advancements," Vijuk, Braun, and Zuchowski, Mar. 1986.

"Advanced Technology for 600 MWe Class PWR Plant," Vijuk, Braun, and Zuchowski, Jun. 1986.

*Primary Examiner*—Carlton R. Croyle

*Assistant Examiner*—Eugene L. Szczecina, Jr.

[57] ABSTRACT

A canned pump is described which includes a motor, impeller, shaft, and high inertia flywheel mounted within a hermetically sealed casing. The flywheel comprises a heavy metal disk made preferably of a uranium alloy with a stainless steel shell sealably enclosing the heavy metal. The outside surfaces of the stainless steel comprise thrust runners and a journal for mating with, respectively, thrust bearing shoes and radial bearing segments. The bearings prevent vibration of the pump and, simultaneously, minimize power losses normally associated with the flywheel resulting from frictionally pumping surrounding fluid.

20 Claims, 5 Drawing Sheets

CANNED PUMP HAVING A HIGH INERTIA FLYWHEEL

This invention was made or conceived in the course of or under Contract No. DE-ACO3-86SF16038 with the United States Department of Energy.

BACKGROUND OF THE INVENTION

This invention, in its preferred form, relates generally to pumps, and, more particularly, canned pumps with high inertia flywheels.

Centrifugal pumps having flywheels are well known, the flywheel being incorporated to mechanically store potential energy during operation of the pump, which energy may be utilized to maintain rotation of the pump in the event of loss of motive power, such as loss of electric power. In nuclear reactors, this technology becomes very important to help maintain coolant circulation through the reactor core after coolant pump trip, since the nuclear fuel continues to give off substantial amounts of heat within the first several minutes after a reactor trip, and cooling is improved with forced flow. The flywheel is generally a metal disk having relatively high mass and being precisely attached to or mounted on the motor shaft for rotation therewith, the inertia of which keeps the shaft rotating after deenergization of the motor.

Pressurized water reactor (PWR) reactor coolant pumps generally include a pump and motor being separated by a complicated shaft seal system, the seals being used as part of the reactor coolant system pressure boundary. The seals are generally subject to about a 2500 psi pressure differential between the reactor coolant system and the containment atmosphere. These seals are susceptible to failure, and may cause a non-isolable leak of primary coolant ranging in size from very small to fairly large. As such, seal failure may result in a challenge to the redundant safety systems provided in nuclear power plants to prevent and mitigate damage to the reactor core.

Canned pumps have been used in nuclear reactor plants for some time, and avoid the problem of the shaft seal arrangement since the entire pump, including bearings and rotor, are submerged in the pumped fluid. Therefore, the use of the pump expressly reduces the potential for a small loss of coolant accident (LOCA). Exemplary canned motor pumps are described in U.S. Pat. Nos. 3,450,056 and 3,475,631. In boiling water reactors, continued rotation of these pumps upon loss of electric power is provided by electro-mechanical means, generally in the form of motor-generator sets having flywheels incorporated therein. The motor-generator set is generally located outside of the reactor containment for accessibility purposes, the electricity being transmitted from the generator to the pump motor through containment wall penetrations. In the event of a loss of electric power to the motor-generator set, the flywheel maintains rotation of the generator for some period of time, which continues to provide power to the pump motor. However, due to the lack of mechanical inertia in the pump itself, any localized failure of the pump or its controls may prevent the pump from extended coast-down. In addition, due to the necessity for extra equipment, this option becomes fairly expensive, both in capital cost and in operation and maintenance cost.

A flywheel within a canned or wet winding pump has been utilized. However, the losses resulting from spinning a large, high mass flywheel through the fluid contained in the pump casing are substantial. The outer surfaces of the flywheel attempt to frictionally pump the surrounding fluid, while the casing surrounding the flywheel inhibits fluid flow. Therefore, turbulent vortices form causing highly distorted fluid velocities which yields substantial drag on the flywheel. This drag is a function of the speed and area of the surface of the flywheel, which both increase with the radius of the flywheel, such drag being commonly understood to increase with about the fifth power of the diameter and about the cube of the angular velocity.

One arrangement to overcome this power loss is disclosed in U.S. Pat. No. 4,084,924 to Ivanoff et al. This patent describes a wet winding pump having a flywheel and a free-wheeling shroud rotatable relative to the shaft and the flywheel The shroud encompasses the flywheel but is spaced apart therefrom and includes passages for ingress and egress of liquid into and out of the space between the flywheel and the shroud. The disclosure envisions that the shroud will rotate at some angular velocity between zero and the velocity of the flywheel, thereby creating two pumped fluid layers, one (between the flywheel and the shroud) being pumped by the flywheel, and the other (the layer outside the shroud) being pumped by the shroud. The lower relative angular velocity between the rotating surfaces therefore results in lower total drag.

Therefore, it is the primary object of the present invention to provide a high-inertia flywheel for a canned or wet winding pump that minimizes the losses associated with the flywheel.

SUMMARY OF THE INVENTION

Described herein is a pump comprising a shaft, an impeller mounted on the shaft for pumping a fluid, drive means engaged with the shaft for turning the impeller, a flywheel mounted on the shaft, the flywheel having a first end surface, a second end surface, and an outer circumferential surface, and radial bearing means substantially mating with the circumferential surface. The pump preferably also includes thrust bearing means substantially mating with one or both ends of the flywheel. The flywheel preferably comprises a heavy metal disk defining a first end, a second end, and an outer circumferential surface, and a shell enclosing the disk for preventing corrosion thereof.

DESCRIPTION OF THE DRAWINGS

The invention will become more readily apparent from the following description of preferred embodiments thereof shown, by way of example only, in the accompanying drawings, wherein.

DESCRIPTION OF THE PREFERRED EMBODIMENT

Figure 1:
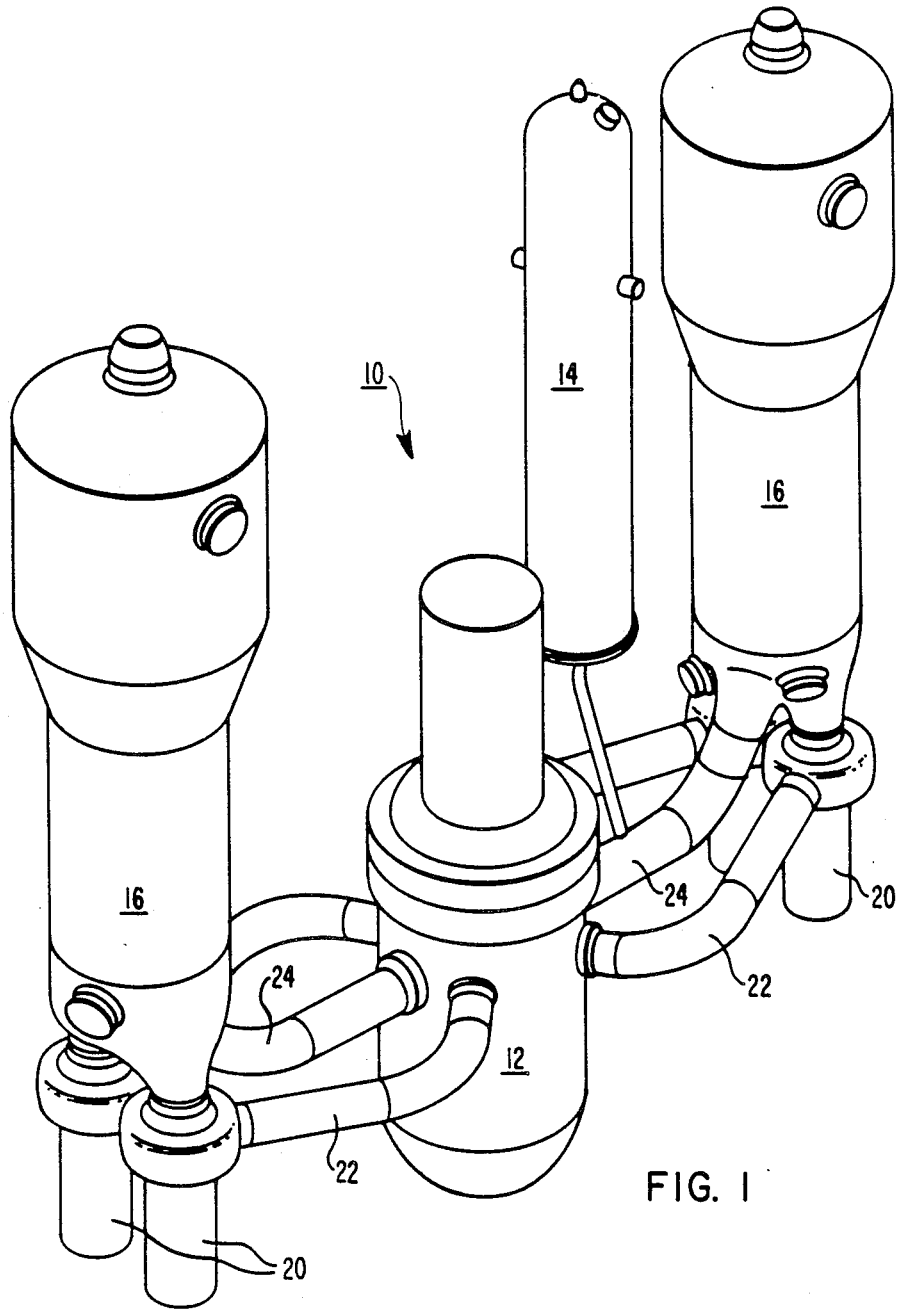
FIG. 1 is a simplified plan view of an advanced reactor coolant system having canned reactor coolant pumps.

Reference will now be made in detail to several present preferred embodiments, some examples of which are illustrated in the accompanying drawings. In the drawings, like reference characters designate like or corresponding parts throughout the several views. Also, it is to be understood that such terms as "forward", "rearward", "left", "right", "upwardly", "downwardly", and the like, are words of convenience only and are not to be construed as terms of limitation.

Referring now to the drawings, and first to FIG. 1, an advanced pressurized water reactor primary coolant system 10 is shown. The system 10 includes a reactor vessel 12, pressurizer 14, one or more steam generators 16, and one or more canned reactor coolant pumps, shown generally as 20. The pumps 20 circulate coolant fluid, normally water, to the reactor vessel 12 through a cold leg 22, through the vessel 12 which embodies the reactor core (not shown), through a hot leg 24 to the steam generator 16, and through the U-bend heat exchanger tubes (not shown) of the steam generator 16.

Figure 2:
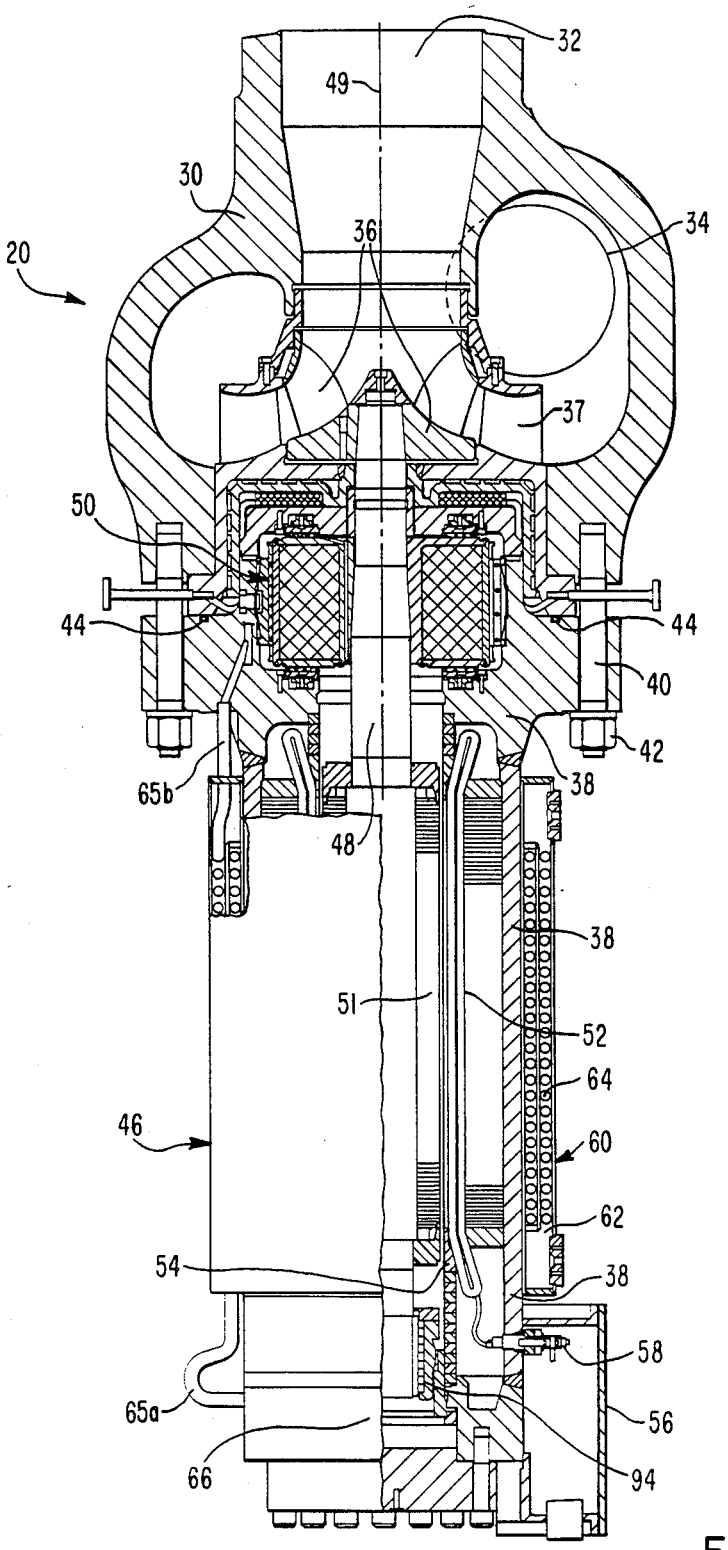
FIG. 2 is a side view, partially in cut out, of a canned reactor coolant pump having a flywheel incorporated therein.

Looking now at FIG. 2, a canned single-stage centrifugal reactor coolant pump 20 having one embodiment of the present invention is shown. The pump 20 includes a pump housing 30 defining suction 32 and discharge 34 nozzles and having an impeller 36 for centrifugally pumping the coolant fluid, whereby water is drawn through the eye of the impeller, discharged through the diffuser 37 and out through the tangential discharge nozzle 34 in the side of the housing 30. The pump 20 includes a hermetically sealed casing 38 removably mounted to the pump housing 30 by a plurality of studs 40 and nuts 42, including therebetween a replaceable gasket 44 to prevent leakage. The pump 20 further includes a motor 46 for driving the impeller 36 via a rotatable shaft 48 about pump centerline axis 49, and a high inertia flywheel assembly 50 mounted on the shaft 48 between the motor 46 and the impeller 36 for mechanical storage of potential energy to be used to continue to rotate the shaft 48 if the motor 46 becomes de-energized.

The motor 46 has a rotor assembly 51 mounted on the shaft 48, a stator assembly 52, and a corrosionresistant stator can 54 separating the stator 52 from the rotor 51, defining the fluid pressure boundary within the pump 20 and also defining a thin boundary layer of fluid between the can 54 and the rotor 51 for minimizing fluid friction losses from rotation of the rotor 51. Electrical connections are made in the terminal box 56, with connections to the stator assembly 52 passing through the casing 38 via terminal assemblies 58. The pump 20 also includes a heat exchanger 60 for removing heat generated by friction and electrical losses within the pump 20. The heat exchanger 60 includes a water jacket 62 having a wound cooling coil 64 therein, the jacket 62 receiving cooling water flow from an external source such as the plant component cooling water system (not shown), for keeping the pump 20 internal temperature at about 150° F. Fluid, at a total flow rate of about 250 gpm, is passed from the jacket 62 through a conduit **65*a* to the lower end of the motor 66, is then passed through the rotor 51 and the stator can 54, being circulated by a small centrifugal auxiliary pump impeller (not shown), details of which are not necessary for an understanding by those skilled in the art, operatively connected to the shaft 48, and after passing the flywheel assembly 50 as described below, is returned to the coil 64 via a second conduit 65*b*. The stator 52 lies outside of the stator can 54 and inside the casing 38, this area normally being dry. However, the casing 38 is designed such that a breach of the can 54 will not cause failure or leakage of fluid from the pump casing 38. An alternative embodiment would be a wet winding pump (not shown), wherein the stator 52** is also submerged in fluid, requiring that winding insulation be perfectly sealed.

Figure 3:
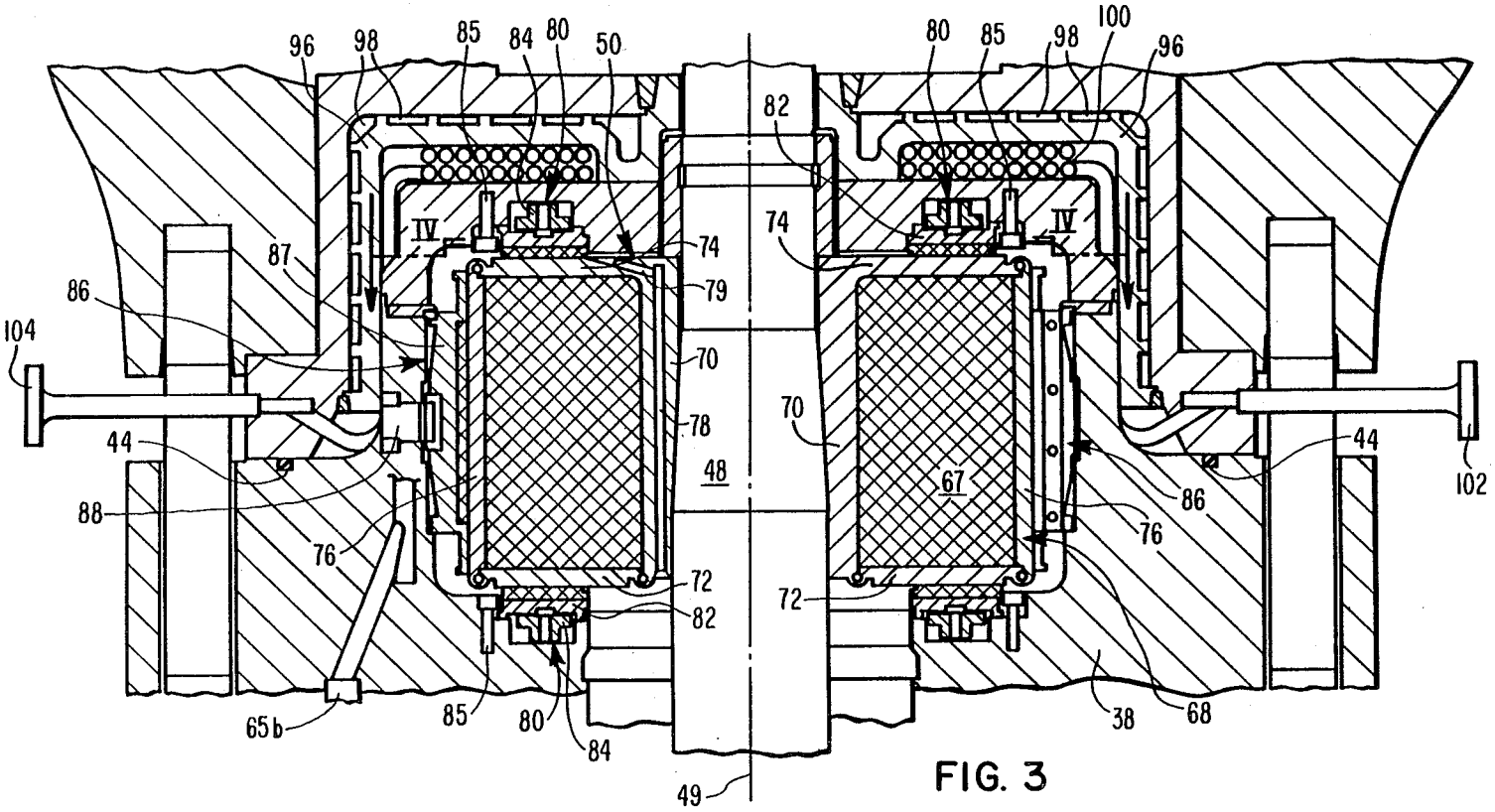
FIG. 3 is a detailed view of the flywheel shown in FIG. 2.
Figure 4:
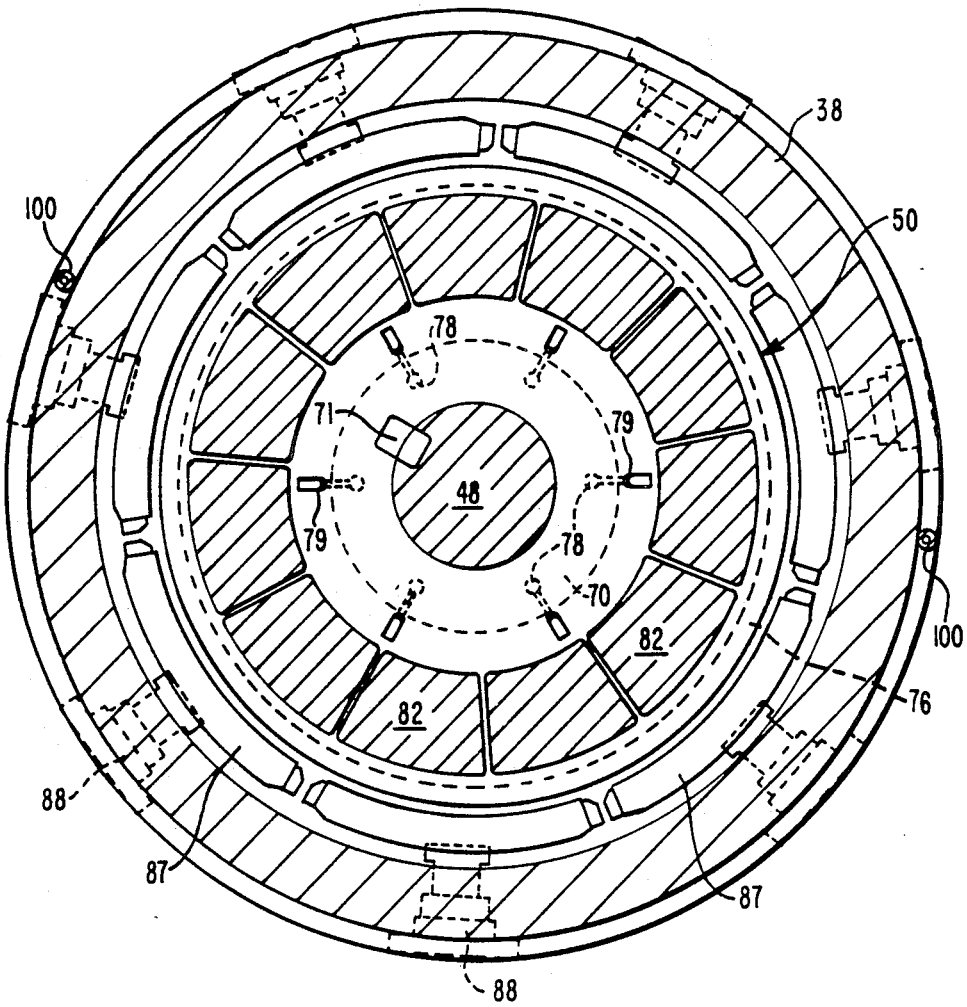
FIG. 4 is a plan view of the flywheel and bearings taken along lines IV—IV of FIG. 3.

Looking now at FIG. 3, the flywheel assembly 50 is shown in greater detail. The flywheel assembly 50 comprises a disk 67 which is preferably made of a heavy metal having very high density and specific gravity such as uranium, tungsten, gold, platinum, or an alloy of one of these elements, chosen to yield the desired inertia. The metal chosen will preferably have a high yield strength, such as in excess of about 60,000 psi, and should be non-brittle, so that the extreme forces exerted on the disk 67 from rotation will not cause failure or excessive deformation of the disk 67. One preferable embodiment is cast, heat treated uranium alloyed with about 2 percent by weight molybdenum, a high density alloy having a minimum yield strength of about 65,000 psi and an elongation of about 22 percent. In the embodiment described herein, the uranium alloy disk 67 has an outer diameter of about 26 inches, an inner diameter of about 9 inches, and a length of about 14.5 inches long, yielding a rotating inertia of about 4000 lb-ft-ft, but it is to be understood that the teachings of this invention may be applied to any size flywheel. The heavy metal disk 67 is enclosed in a stainless steel shell 68 comprised of four members: an inner diameter annular plate 70 disposed around shaft 48 having an inner diameter of about 7.75 inches for mating with the shaft 48, a first end plate 72, a second end plate 74, and an outer circumferential plate 76. The four plates 70, 72, 74, 76 are welded together to sealably enclose the disk 67, thereby preventing corrosion or erosion of the heavy metal. The inner diameter plate 70 mates with and is keyed, as is best shown in FIG. 4, by one or more keys 71 to the shaft 48, as is known to those skilled in the art for joining flywheels to shafts. The inner plate 70 also includes a plurality of flow channels 78 cut or drilled therethrough to allow cooled fluid from the heat exchanger 60 to flow around and cool the flywheel assembly 50. Each flow channel 78 preferably includes a radially extending end portion 79 for directing coolant flow outwardly away from the shaft 48, the end portions 79 tending to centrifugally pump the fluid to increase coolant flow and overcome friction losses.

The first end plate 72 and the second end plate 74 lie generally perpendicular to the shaft 48, and the surfaces thereof may be utilized as thrust runners. As such, thrust bearing means 80 are disposed within the casing 38 for substantially mating with the plates 72, 74. The thrust bearing means 80 includes a plurality of thrust bearing shoes 82, 11 on each side of the flywheel assembly 50 in the present embodiment, mounted to the casing 38 by precipitation hardened stainless steel thrust links 84 and thrust shoe retainers 85. The thrust links 84 generally include primary and secondary links which provide self leveling and load equalization for the thrust shoes 82, which is common in the art and does not need to be detailed for a thorough understanding of the present invention. The thrust bearings 80 absorb forces exerted along the longitudinal axis of the pump 49 and minimize movement and vibration along that axis 49. Hydraulic analysis of the pump design has shown a calculated rotor up-thrust condition, requiring thrust bearings 80 below the runner 72 for start-up conditions when the pump rotor 51 has low angular velocity, and above the runner 74 for normal running conditions, when the rotor 51 creates a steady-state upwardly directed thrust.

The outer circumferential plate 76 is utilized as a radial journal and is substantially mated with radial bearing means 86. The radial bearing means 86 is comprised of a plurality of radial bearing segments 87, the current embodiment having 7 segments, disposed about the periphery of the flywheel assembly 50, as is best seen in FIG. 4, each segment 87 being mounted to the casing 38 by precipitation hardened stainless steel radial pivot pins 88. The pins 88 allow vertical and circumferential tilt capability for alignment and hydrodynamic film generation between the segment 87 and the plate 76. It is expressly envisioned that the bearing means 80, 86 utilized in this invention may be of the Kingsbury type, as is known in the art. It has been calculated that the losses associated with the radial bearing means 86 and the thrust bearing means 80 may be less than if the outer surface 76 and ends 72, 74 of the flywheel 50 were left free to spin in fluid, as hereinbelow described. Thus, while it is normal in the art to dispose radial bearings on the shaft at a location having as minimal a radius as possible so as to reduce the surface speed at the bearing face, the current embodiment justifies the relatively high bearing power loss associated with disposing the radial bearing segments 87 about the circumference of the flywheel 50.

Figure 5:
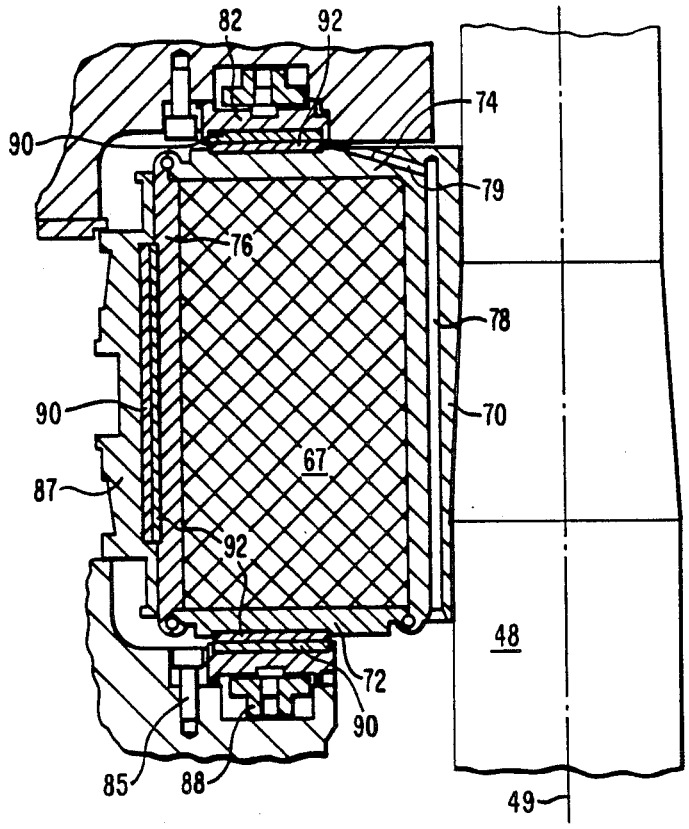
FIG. 5 is a simplified cross section of a flywheel and bearing shoes showing details of the mating surfaces.

As shown best in FIG. 5, each thrust bearing shoe 82 and each radial bearing segment 87 will preferably include a carbon graphite insert, shown representatively by 90, ground and crowned to provide surface finish and contour for water lubricated service. In addition, the end plates 72, 74 and the outer circumferential plate 76 will include a hardened material facing 92, such as stellite, properly ground for mating with the thrust shoes 82 and radial segments 87, respectively.

The entire rotor 51 and flywheel 50 assembly is immersed in reactor coolant water, at coolant system pressure, and, during steady-state operation, there is no transport of fluid between the reactor coolant system and the motor casing 38. As above described, the pump heat exchanger 60 removes heat created within the pump 20 by friction and electrical loss. The water flows over the bearing means 80, 86 for heat removal therefrom, and importantly, flows between the bearing inserts 90 and the flywheel facings 92, thereby maintaining the thin fluid film important to low friction service and preventing damage to the bearing and flywheel surfaces 90, 92. To augment flow to the thrust bearing means 80 on the top side of the flywheel 50, as described above and as seen in FIGS. 3, 4, and 5, the present embodiment has 6 flow passages 78, 79 drilled through the inner diameter plate 70, which pass about 50 gpm to these bearings. The rest of the total coolant flow of 250 gpm flows past the lower thrust bearings 80 and then past the radial bearings 86 to the return line 65*b*.

The losses of a flywheel having the same inertia as described above but spinning in water have been calculated to be about 366 horsepower. The power loss in the above described embodiment has been calculated to be about 207 horsepower. This is the result of the small gaps between the flywheel surface facings 92 and the bearing inserts 90. The gap with the radial bearing segments 87 is expected to be about 5 mils, and the gap with the thrust bearing shoes 82 is expected to be about 1 to 2 mils. These water gaps should reduce the friction loss of the flywheel 50. Incorporating the bearings around the flywheel also has the benefit of replacing normal thrust and radial bearings of the pump, where, looking back FIG. 2, in the embodiment shown, the only other main bearing necessary is shaft radial bearing 94 located aft of the motor 46.

The present embodiment also includes means for separating the hot impeller 36 and reactor coolant system piping from the casing 38 around the bearings 80, 86. As seen in FIG. 3, an insert 96 is provided within the casing 38 defining chambers 98 therebetween, the dead air space of which insulates the casing 38 from heat transport from the pumped fluid and hot impeller 36. In addition, cooling coils 100 are provided between the insert 96 and the casing 38, receiving and returning cooling water from an external source through inlet 102 and discharge 104 piping.

It is within the scope of the present invention to maximize the parameters of the current design by minimizing the power losses associated with the flywheel and bearing assemblies and maximizing the inertia. Inertia of the flywheel varies directly with about the fourth power of the radius of the flywheel, and power loss, due to the greatly increased speed of the outer surface of the flywheel as radius increases, varies directly with diameter to about the fifth power, therefore the equations describing inertia and power loss may be jointly solved to obtain the preferable dimensions of the flywheel.

It will be apparent that many modifications and variations are possible in light of the above teachings, for example, the flywheel assembly 50 may be mounted aft of the motor 46. It, therefore, is to be understood that within the scope of the appended claims, the invention may be practiced other than as specifically described.

We claim:

1. A pump comprising:

a. a shaft;

b. an impeller mounted on said shaft for pumping a fluid;

c. drive means engaged with said shaft for turning said impeller;

d. a flywheel mounted on said shaft, said flywheel having a first end surface, a second end surface, and an outer circumferential surface; and e. radial bearing means substantially mating with said circumferential surface.

2. The pump according to claim 1, wherein said drive means is an electric motor including a stator and a rotor, said rotor being mounted on said shaft.

3. The pump according to claim 2 wherein said pump is a canned pump having said shaft, impeller, motor, and flywheel enclosed in a hermetically sealed casing.

4. The pump according to claim 3, further comprising thrust bearing means substantially mating with one said end of said flywheel.

5. The pump according to claim 4, wherein said thrust bearing means includes a plurality of thrust bearing shoes mounted to said casing by thrust links for providing self-leveling and load equalization of said thrust shoes.

6. The pump according to claim 3, wherein said radial bearing means includes a plurality of bearing segments extending around the periphery of said cylinder and mating therewith, said segments being supported within said casing by radial pivot pins.

7. The pump according to claim 1, wherein, said bearing means includes carbon graphite inserts for minimizing friction losses.

8. The pump according to claim 1, wherein said flywheel includes stellite pads on the surfaces thereof for mating with said bearing means and minimizing friction losses.

9. The pump according to claim 1, wherein said flywheel has a substantially right rectangular cross-section.

10. The pump according to claim 1, wherein said flywheel is made out of a heavy metal.

11. The pump according to claim 10, wherein said heavy metal has a yield strength greater than about 60 ksi.

12. The pump according to claim 10, wherein said heavy metal is one chosen from the group consisting of gold, uranium, titanium, and platinum.

13. The pump according to claim 10, wherein said heavy metal is an alloy.

14. The pump according to claim 13, wherein said alloy is uranium alloyed with molybdenum.

15. The pump according to claim 10, wherein said flywheel further includes a stainless steel jacket therearound to prevent corrosion of said heavy metal.

16. A canned reactor coolant pump having a hermetically sealed casing, an electric motor for driving a shaft, an impeller operatively connected to said shaft for pumping a fluid, and a flywheel mounted on said shaft, said flywheel comprising:

a. a heavy metal disk defining a first end, a second end, and an outer circumferential surface;

b. a shell enclosing said disk for preventing corrosion thereof.

17. The pump according to claim 16, wherein said shell further defines thrust runners on said ends and a journal around said circumferential surface, said pump further including radial bearing means mating with said journal and thrust bearing means mating with one said thrust runner.

18. The pump according to claim 17, wherein said radial bearing means includes a plurality of radial bearing members mounted to said casing by radial pivot pins, and said thrust bearing means includes a plurality of thrust bearing shoes, each shoe being mounted to said casing by primary and secondary thrust links.

19. The pump according to claim 17, wherein said shell is made of stainless steel and includes stellite pads on said thrust runners and journal.

20. The pump according to claim 16, wherein said disk is uranium alloy containing about 2 percent by weight molybdenum.

* * * * *